United States Patent [19]

Landa

[11] 4,340,312

[45] Jul. 20, 1982

[54] BARRELLESS GUN FOR MICROBALLISTIC PRINTER

[75] Inventor: Benzion Landa, Edmonton, Canada

[73] Assignee: Savin Corporation, Valhalla, N.Y.

[21] Appl. No.: 190,368

[22] Filed: Sep. 24, 1980

[51] Int. Cl.[3] ..... B41J 3/02

[52] U.S. Cl. ..... 400/118; 400/121

[58] Field of Search ..... 400/16, 17, 118, 119, 400/121, 126; 101/114; 340/764, 783, 788; 346/141; 51/310, 319, 320, 424; 72/53; 124/41 R, 51 A, 51 R, 71

[56] References Cited

FOREIGN PATENT DOCUMENTS 51-1028419 12/1976 Japan ..... 400/118

*Primary Examiner*—Paul T. Sewell

*Attorney, Agent, or Firm*—Shenier & O'Connor

[57] ABSTRACT

A barrelless gun for use with a microballistic printer to propel balls toward a printing medium in which the ball next to be fired is releasably held in a resilient breech with gas under pressure supplied to the region behind the breech and with the region in front of the breech extending to the medium being unobstructed so that no element of structure affects the flight of a ball fired from the breech. Preferably the ball in the breech is fired by moving another ball into the breech to dislodge the first ball.

7 Claims, 4 Drawing Figures

BARRELLESS GUN FOR MICROBALLISTIC PRINTER

BACKGROUND OF THE INVENTION

In copending application Ser. No. 39,372, filed May 15, 1979, now abandoned I describe a printer which directs a plurality of small projectiles such as balls of about one millimeter in diameter in extremely rapid succession against a printing medium such as a ribbon overlying a sheet of paper. In the gun of the printer, which is movable about orthogonal axes for aiming, balls are introduced successively into a resilient breech which is slightly smaller in diameter than the balls. Air is maintained under superatmospheric pressure in a chamber behind the breech. The ball is fired by pushing it sufficiently far through the breech to snap it through to the barrel side and allow the pressurized air to expand into the barrel and propel the ball outwardly.

While the barrel of the aforementioned ball gun permits the air from the pressure chamber to act on the ball being propelled with a high degree of efficiency, it also has certain drawbacks. First, it has been found that deposits of dirt or other forms of contamination tend to build up in the area between the front edge of the construction and the rear edge of the barrel. If these deposits build up asymmetrically around the barrel, they can severely degrade or destroy the accuracy of the ball gun.

Secondly, the barrel must be accurately centered relative to the breech. In apparatus of the type contemplated, in which the ball diameter, and hence the barrel diameter, is less than a millimeter, achievement of the necessary tolerances can be quite difficult and expensive.

SUMMARY OF THE INVENTION

One of the objects of my invention is to provide a ball gun for use with a microballistic printer which remains accurate even after long periods of use.

Another object of my invention is to provide a ball gun for use with a microballistic printer which does not require excessively precise manufacturing tolerances.

Other and further objects of my invention will be apparent from the following description.

In general my invention contemplates the provision of a gun assembly for use with a microballistic printer in which a first projectile next to be fired is retained in a restricted aperture formed in a diaphragm of resilient material against the action of gas at a superatmospheric pressure at one side of the diaphragm. The region on the other side of the aperture is an open unrestricted space. The gun is fired by forcing a second projectile into engagement with the first projectile from said one side of said diaphragm with sufficient force to dislodge said first projectile whereby said gas propels said first projectile through said space along a straight line.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENTS

Figure 1:
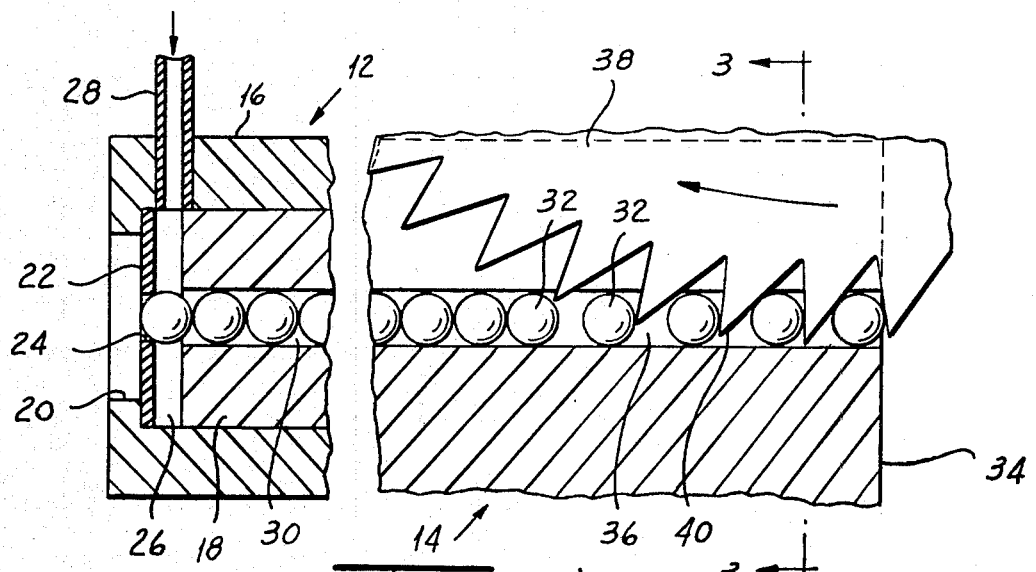
FIG. 1 is a fragmentary section, viewed from below, of one embodiment of my barrelless ball gun and associated ball injector.
Figure 2:
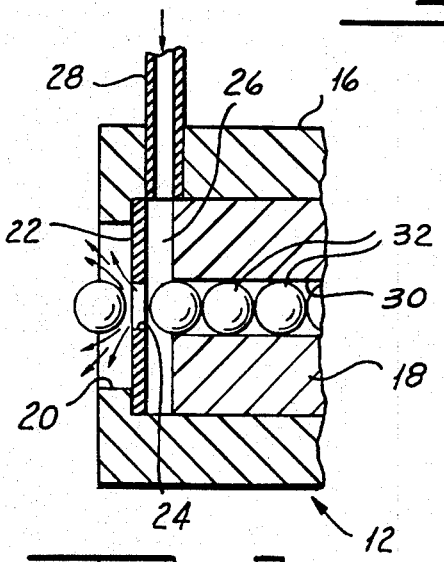
FIG. 2 is a fragmentary section of the ball gun shown in FIG. 1, illustrating a stage in the operating sequence in which a ball has just been fired.
Figure 3:
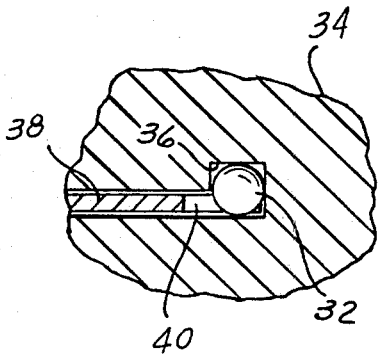
FIG. 3 is a fragmentary section of the injector shown in FIG. 1, taken along line 3—3 thereof.

Referring now to FIGS. 1 to 3, in one embodiment of my invention, a ball gun indicated generally by the reference numeral 12 successively fires balls 32, fed to the gun by a ball injector indicated generally by the reference numeral 14, at a suitable target such as the printing medium shown and described in my copending application Ser. No. 39,372. In the gun 12, a generally tubular housing 16 formed with a radially inwardly extending flange 20 at one end thereof receives a tubular guide 18, the end of which is spaced from flange 20 to form a chamber 26. Flange 20 retains a circular diaphragm 22 formed of a suitable resilient material such as the polyester film sold by E. I. duPont deNemours & Co. under the trademark MYLAR. Diaphragm 22 is formed with a central aperture 24 slightly smaller in diameter than the balls 32 to form a restricted passage therefor. An inlet 28 supplies chamber 26 with air or other gas at a pressure in excess of atmospheric pressure of preferably about 4 to 6 atmospheres. I form guide 18 with an axial bore 30, slightly greater in diameter than the balls 32, to form a passage for receiving and holding balls to be fired.

In the ball injector 14, a rotary saw blade 38 formed with teeth 40 urges balls 32 held in a reservoir (not shown) into a channel 36 formed in a guide 34, from which they move into the bore 30. As the saw blade 38 rotates, it urges the leftmost ball 32 with increasingly greater force into the aperture 24 of diaphragm 22, finally pushing the ball through to the other side. When this happens, the pressurized air in chamber 26 issues through the aperture 24 as shown in FIG. 2, propelling the ball along the desired trajectory. As illustrated in FIG. 2, air previously under pressure in chamber 26 continues to act against the ball 32 for an appreciable distance after the ball has left the aperture 24. Moreover, the pattern of air flow is such as to center the ball 32 to maintain the desired trajectory.

Figure 4:
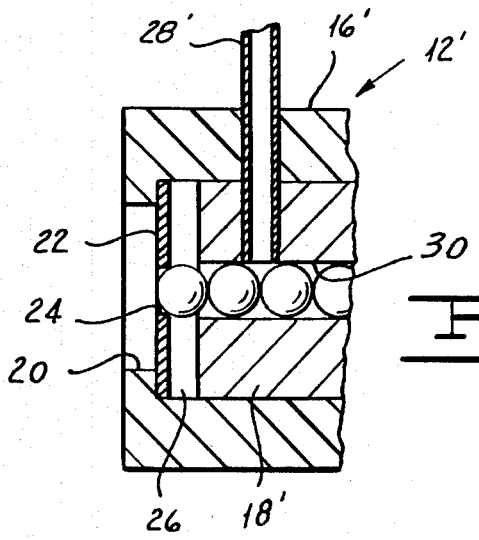
FIG. 4 is a fragmentary section of a modified form of ball gun constructed according to my invention.

While, in the embodiment shown in FIGS. 1 to 3, I have shown the inlet 28 leading directly into the chamber 26, the inlet may, if desired, be disposed at a point further upstream along the ball path, as in the embodiment shown in FIG. 4. In this modified ball gun, indicated generally by the reference numeral 12', the inlet 28' passes through the housing 16' and guide 18' to open onto the bore 30. In the assembly 12', the clearance of the balls 32 relative to the bore 30 and the relative length of bore 30 to the left and right of inlet 28' should be such as to minimize the pressure loss at the diaphragm 22. If desired, the pressure chamber 26 in a gun 12' may be eliminated altogether and the left end of guide 18' simply disposed abutting diaphragm 22.

It will be seen that I have accomplished the objects of my invention. I have provided a ball gun for a microballistic printer which remains accurate even after long periods of use. My gun does not require overly precise manufacturing tolerances.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A barrelless gun for use in a microballistic printer to propel balls toward a printing medium including in combination, a diaphragm of resilient material formed with an aperture having a diameter slightly less than that of a ball, means for lodging a first ball in said aperture from one side of said diaphragm with a force which is insufficient to overcome the resilience of said diaphragm, means for supplying gas under pressure to said one side of said diaphragm, the space immediately on the other side of said diaphragm being open and extending to said printing medium so that no element of structure affects the flight of a ball as it leaves said aperture, and means for bringing a second ball into engagement with said first ball from said one side of said diaphragm with sufficient force to dislodge said first ball to permit said gas under pressure to propel said first ball toward said medium.

2. A barrelless gun for use in a microballistic printer or the like to propel balls toward a printing medium including in combination, a diaphragm of resilient material formed with an aperture having a diameter slightly less than that of a ball, means for lodging a ball in said aperture from a first side of said diaphragm with a force which is insufficient to overcome the resilience of said diaphragm, means for supplying gas under pressure to said one side of said diaphragm, the space immediately on the other side of said diaphragm being open and extending to said printing medium so that no element of structure affects the flight of a ball as it leaves said aperture, and means for dislodging said ball from said aperture to fire the same toward said medium under the pressure of said gas.

3. A barrelless gun for use in a microballistic printer or the like to propel balls toward a printing medium including in combination, a diaphragm of resilient material formed with an aperture having a diameter slightly less than that of a ball, means for lodging a ball in said aperture from a first side of said diaphragm with a force which is insufficient to overcome the resilience of said diaphragm, the space immediately on the other side of said diaphragm being open and extending to said printing medium so that no element of structure affects the flight of a ball as it leaves said aperture, and means for dislodging said ball from said aperture and fire the same toward said medium.

4. A barrelless gun for use in a microballistic printer or the like to propel balls toward a printing medium including in combination, a diaphragm of resilient material formed with an aperture having a diameter slightly less than that of a ball, means for lodging a first ball in said aperture from a first side of said diaphragm with a force which is insufficient to overcome the resilience of said diaphragm, the space immediately on the other side of said diaphragm being open and extending to said printing medium so that no element of structure affects the flight of a ball as it leaves said aperture, and means including means for bringing a second ball into engagement with said first ball from said one side of said diaphragm with sufficient force to dislodge said first ball and to fire said first ball toward said medium.

5. In a microballistic printer for firing solid balls toward a printing medium, apparatus including means forming a resilient breech for releasably holding a ball, means for feeding a ball to said breech from one side thereof, means for forming a pressurized region on said side of said breech to exert a force on said ball tending to urge said ball through said breech, said breech so oriented that said force is directed toward said medium, and means for overcoming the releasable holding action of said breech to allow pressure from said region to propel said ball toward said medium, the space immediately on the other side of said breech being open and extending to said medium so that no element of structure affects the flight of a ball leaving said breech.

6. In a microballistic printer for firing solid balls toward a printing medium, apparatus including means forming a resilient breech for releasably holding a ball, said breech having a diameter slightly less than the diameter of said ball, means for feeding a ball to said breech from one side thereof, means for exerting a force on said ball tending to urge said ball through said breech, said breech being so oriented that said force is directed toward said medium, and means for overcoming the releasable holding action of said breech to allow said force to propel said ball toward said medium, the space immediately on the other side of said breech being open and extending to said medium so that no element of structure affects the flight of a ball leaving said breech.

7. In a microballistic printer for firing solid balls toward a printing medium, apparatus including means forming a resilient breech for releasably holding a ball, means for feeding a ball to said breech from one side thereof, means for exerting a force on said ball tending to urge said ball through said breech, said breech being so oriented that said force is directed toward said medium, and means for overcoming the releasable holding action of said breech to allow said force to propel said ball toward said medium, the space immediately on the other side of said breech being open and extending to said medium so that no element of structure affects the flight of a ball leaving said breech.

* * * * *